US006296318B1

(12) United States Patent
Simons et al.

(10) Patent No.: US 6,296,318 B1
(45) Date of Patent: Oct. 2, 2001

(54) DEVICE FOR MILLING OFF GROUND SURFACES ESPECIALLY ROADWAYS

(75) Inventors: Dieter Simons, Buchholz; Peter Busley, Willroth; Herbert Ley, St. Katharinen, all of (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 09/252,366

(22) Filed: Feb. 18, 1999

Related U.S. Application Data

(63) Continuation of application No. PCT/EP98/02755, filed on May 12, 1998.

(30) Foreign Application Priority Data

Jun. 20, 1997 (DE) ..... 197 26 122

(51) Int. Cl.[7] ..... E01C 23/12

(52) U.S. Cl. ..... 299/39.2; 299/39.1; 299/64; 404/90; 198/300

(58) Field of Search ..... 198/510.1, 518, 198/300; 299/29, 36.1, 39.1, 39.2, 39.4, 64; 404/90, 91

(56) References Cited

U.S. PATENT DOCUMENTS 4,184,581 * 1/1980 Crawshay et al. ..... 199/308
5,441,361 * 8/1995 Campbell ..... 404/90

FOREIGN PATENT DOCUMENTS

| | | |
|---|---|---|
| 37 33 644 A1 | 4/1989 | (DE) . |
| 38 31 161 C1 | 2/1990 | (DE) . |
| 39 03 482 A1 | 8/1990 | (DE) . |
| 0 744 495 A2 | 11/1996 | (EP) . |
| 2 1 54 266 A | 1/1985 | (GB) . |
| WO 95/16826 | 6/1995 | (WO) . |

* cited by examiner

*Primary Examiner*—David Bagnell
*Assistant Examiner*—John Kreck
(74) *Attorney, Agent, or Firm*—Waddey & Patterson; Emily A. Shouse

(57) ABSTRACT

In a device for milling off ground surfaces, especially roadways, having a wheel frame carrying a machine frame, a milling roller supported in the machine frame and extending transversely to the direction of travel, at least one conveyor means arranged in front of the milling roller in the direction of travel for removing the milled material, and having a shield arrangement extending transversely to the direction of travel between the milling roller and the conveyor means having a vertical cover plate with a passage opening for the milled material, it is provided that the end, on the side of the milling roller, of the conveyor means is dismountably supported in a belt shoe fixed to the machine frame in a height-adjustable manner, and that the belt shoe and the conveyor means comprise guiding means and coupling means adapted to one another.

39 Claims, 5 Drawing Sheets

DEVICE FOR MILLING OFF GROUND SURFACES ESPECIALLY ROADWAYS

This application is a continuation application of co-pending PCT/EP98/02755, filed May 12, 1998, which claims priority from German application No. 197 26 122.1, filed Jun. 20, 1997.

This application claims benefit of PCT/EP98/02755, filed May 12, 1998, and German application no. 197 26 122.1, filed Jun. 20, 1997.

BACKGROUND OF THE INVENTION

The invention relates to a device for milling off ground surfaces, especially roadways.

Such devices are also called front-loading milling cutters. Such a front-loading milling cutter is known, for example, from DE 39 03 482 A1. The known milling machines comprise an automotive wheel frame comprising a pair of front wheels and a pair of rear wheels. The wheel frame carries a machine frame in which a milling roller is supported transversely to the direction of travel. To achieve as complete a removal as possible of the milled material, the milling roller is usually surrounded by a housing in which the wall directed towards the direction of travel is formed as a cover plate having a passage opening for the milled material. The material taken off by the milling roller is discharged by the milling roller onto a first transport belt transferring the milled material, on the frontal end of the milling cutter, onto a discharge belt being pivotable in inclination and laterally for a transport onto a loading area of a truck.

The milling roller is equipped with chipping tools forming a conveyor coil transporting the milled material to the passage opening of the cover plate.

The first transport belt in front of the milling roller can easily be damaged by breaking ground plates, making it necessary to dismantle the conveyor means for repairing the transport belt. Dismantling and assembling the conveyor means is very labor-intensive and time-consuming. Furthermore, several people are required to perform these operations.

Thus, what is needed then is a device of the kind mentioned above so that the conveyor means is better protected against damages, on the one hand, and can be dismantled and assembled with as little use of personnel and time as possible.

SUMMARY OF THE INVENTION

The invention advantageously provides that the end of the conveyor means proximate to the milling roller is supported, in an easily detachable way, in a belt shoe being arranged, in a height-adjustable manner, on the machine frame and that the belt shoe and the conveyor means comprise guiding and coupling means adapted to each other. The belt shoe, approximately L-shaped in the longitudinal section thereof, comprises a readily dismountable support for the rear end of the conveyor means and thereby enables substantially shortened assembly and dismounting times for the conveyor means during repair work. Furthermore, the conveyor veyor means is better protected against damages towards the ground surface and the milling roller so that less repair work occurs. The essential advantages of the belt shoe consist in the protection of the conveyor means from damages, on the one hand, and the integrated guidance of the lower end of the conveyor means, on the other hand. The belt shoe protects both from damages to the transport belt of the conveyor means from below and from damages to the transport belt by means of the charged milled material, by the belt shoe preventing milled fragments from getting between the conveyor belt and the cover plate and damaging the conveyor belt at the rerouting position of the conveyor belt.

The belt shoe comprises a vertical wall element having a passage opening, a grate horizontally projecting on the lower end of the wall element in the direction of travel as well as lateral walls projecting upwards, extending parallel to the direction of travel and enclosing the grate, the end of the conveyor means on the side of the milling roller being supported pivotably therebetween. While the vertical wall element of the belt shoe functions as a vertical shield, the grate serves as a supporting, sliding and holding-down element abutting on the bottom surface. The lateral walls allow for guiding and supporting the rear end, on the side of the milling roller, of the conveyor means. The conveyor means is supported pivotably between the lateral walls of the belt shoe.

A passage opening in a vertical wall element of the belt shoe co-operates with the passage opening of the cover plate. The passage opening of the belt shoe being able to be height-adjusted relative to the depth of milling is always arranged in the same position relative to the conveyor means so that optimum conditions are present for removing the milled material by the conveyor means.

The guiding and coupling means of the conveyor means comprise, for example, laterally projecting guide bolts allowing for a pivotability of the conveyor means.

The conveyor means can extend upwards at an angle of inclination to the horizontal line, the guiding means of the belt shoe on the lateral walls comprising guiding elements extending at the angle of inclination of the conveyor means. The guiding means of the belt shoe thus forms a prolongation of the guiding means of the machine frame for the conveyor means.

It is preferably provided that the lateral walls on the end, on the side of the milling roller, of the guiding elements comprise reception means for the guide bolts of the guiding means in which the guide bolts are lockable and simultaneously serve as a limit stopper for the conveyor means. Thus, the belt shoe simultaneously serves as a guiding and locking means.

As an alternative, the conveyor means can be guided and supported movably in the belt shoe and be biased against the stopper on the belt shoe towards the milling roller. For this purpose, the belt shoe comprises a longitudinal support.

In a preferred embodiment, the guiding elements of the lateral walls comprise a guide surface, on the upper edge of the lateral walls, extending at the angle of inclination of the conveyor means. The guide bolts of the conveyor means can slide on these guide surfaces into the stopping and locking position on the belt shoe. On the other hand, the guide surfaces on the belt shoe protect the rear end of the conveyor means when it is pulled out of the machine frame until the conveyor means is sufficiently supported by the machine frame.

As an alternative, the guiding elements on the lateral walls can comprise rails or grooves adapted to the guide bolts of the conveyor means and extending at the angle of inclination of the conveyor means.

The machine frame comprises a shaft extending at the angle of inclination of the conveyor means, in which the conveyor means can be inserted into the end support by means of a pairing of rails and rolls. The rails are preferably arranged on the shaft of the machine frame, and the guiding rolls are arranged on the conveyor means.

It is especially preferred to use the axially exterior areas of the support rollers for the lower run of a transport belt of the conveyor means simultaneously as guiding rolls for the conveyor means.

In this context, the supporting rolls and the guiding rolls, respectively, do not abut on the guiding rails in the shaft of the machine frame in the end position of the conveyor means in the belt shoe.

The belt shoe comprises, on the frontal side thereof, a shield in the shape of the bow of a ship, protecting the belt shoe from damage.

Stiffening ribs extending transversely to the lateral walls can be provided in the belt shoe, providing the belt shoe with a high stability and connecting the grate bars of the grate with one another.

The conveyor means comprises two further laterally projecting guide bolts on the frontal end thereof averted from the milling roller, which bolts are insertable in the shaft into a longitudinal support when the guiding means is inserted in the belt shoe. In this process, the conveyor means is raised so that the guiding rolls of the conveyor means no longer abut on the guiding rails in the shaft of the machine frame. The longitudinal support also allows for a limited movement of the conveyor means, for example when the conveyor means is supported by means of a tension spring against a stopper in the belt shoe or when the conveyor means is adjusted due to an adjustment of the depth of milling.

DESCRIPTION OF THE PREFERRED EMBODIMENT

Figure 1:
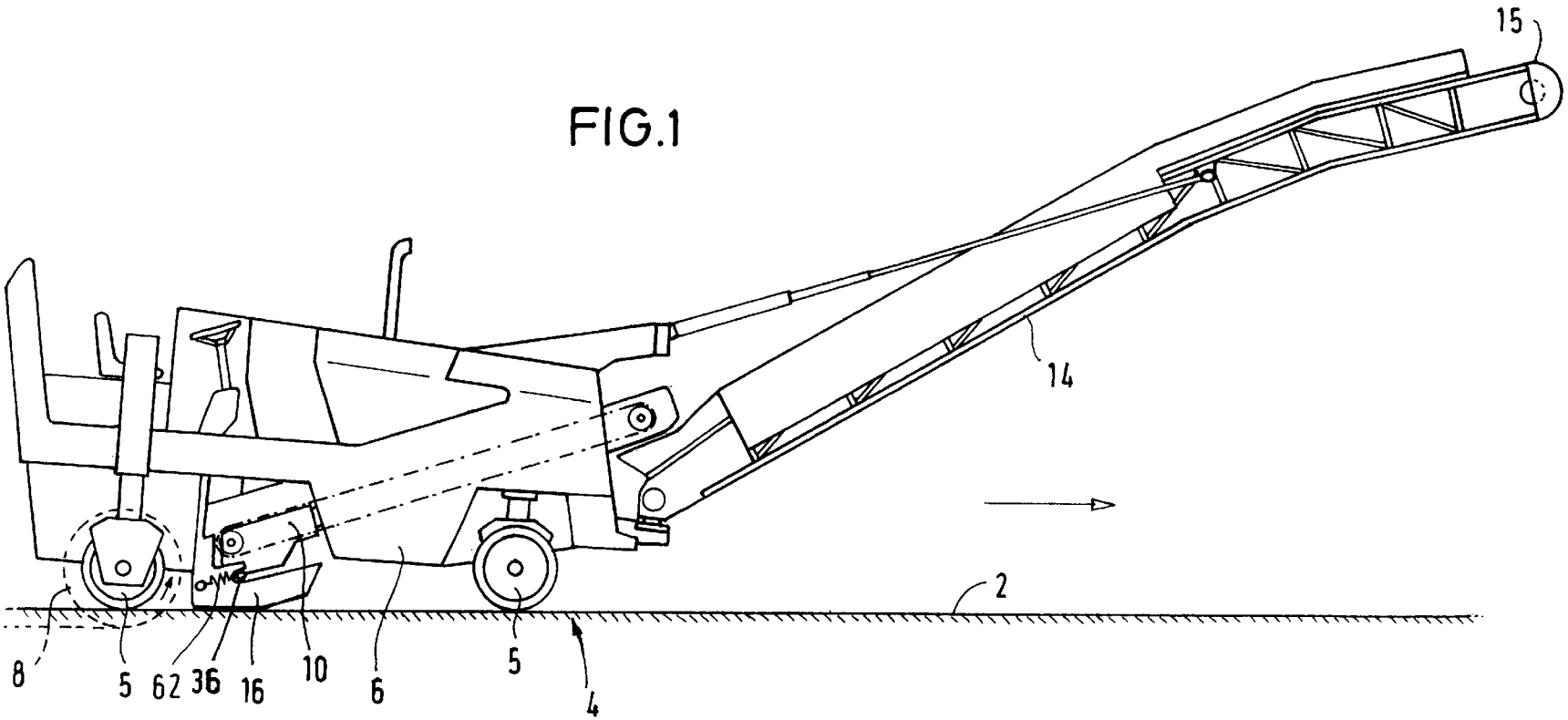
FIG. 1 shows a device for milling off ground surfaces according to the invention.
Figure 3:
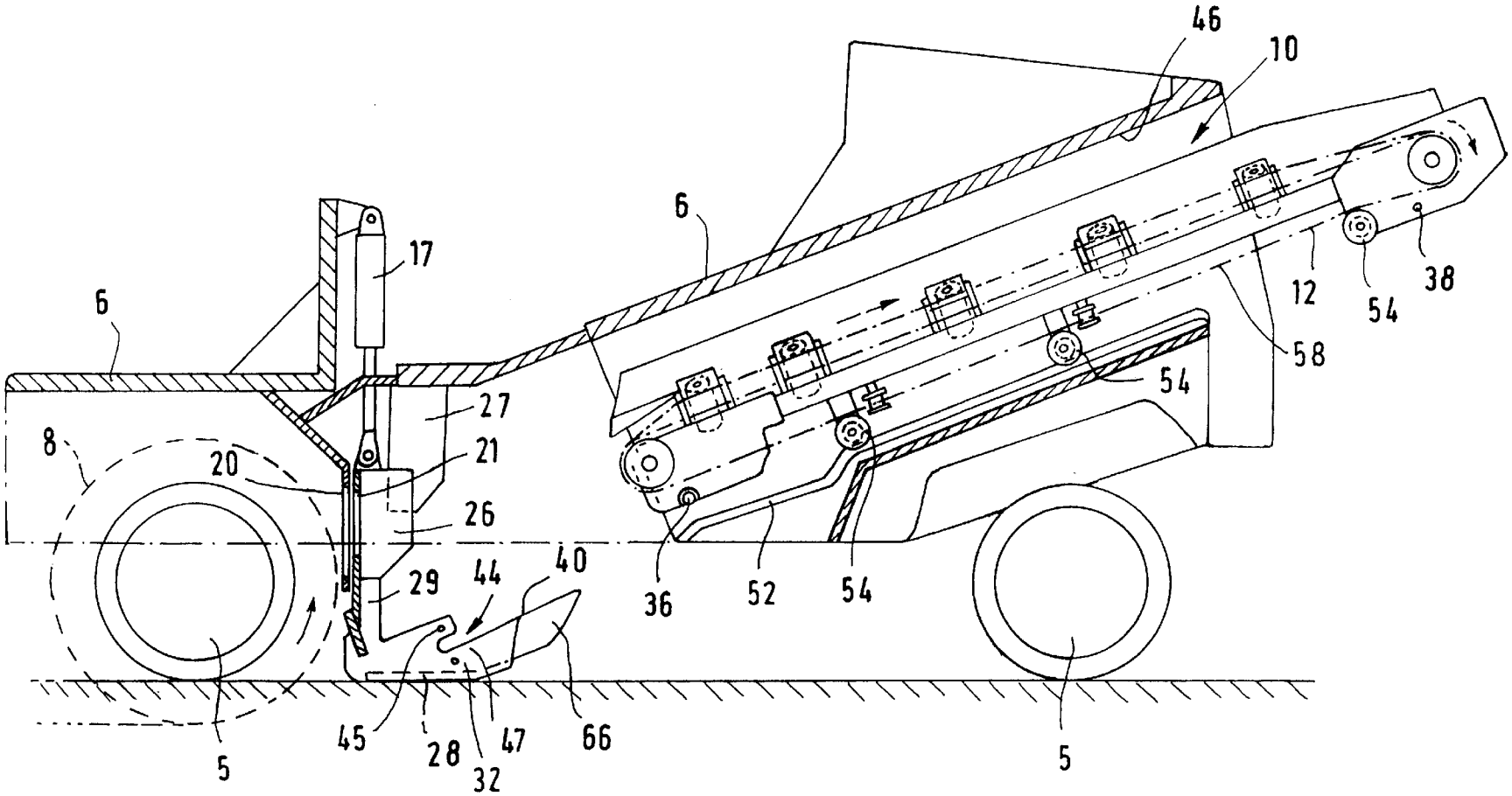
FIG. 3 shows an intermediate position when mounting the conveyor means.

A device for milling off ground surfaces 2, especially roadways of asphalt, concrete or the like, having a wheel frame 4 carrying a machine frame 6 and a milling roller 8 being supported on the machine frame 6 and extending transversely to the direction of travel between the rear wheels 5 of the wheel frame 4 is represented in FIG. 1. The adjustment of the depth of milling takes place by means of the height adjustment of the rear wheels 5. Such machines are also called front-loading milling machines, as they transport the milled material in the direction of travel towards the front onto transport vehicles. With reference to FIGS. 1 and 3, in front of the milling roller 8, in the direction of travel, a first conveyor means 10 having a transport belt 12 is arranged, being arranged at an angle of inclination in the machine frame 6 and transferring the milled material onto a second conveyor means 14 having a further transport belt or discharge belt 15. The second transport means 14 is height-adjustable through an adjustable angle of inclination and can further be pivoted laterally by ±30°, for example, so that transport vehicles positioned to the side of the lane of the front-loading milling machine can be charged.

Figure 5:
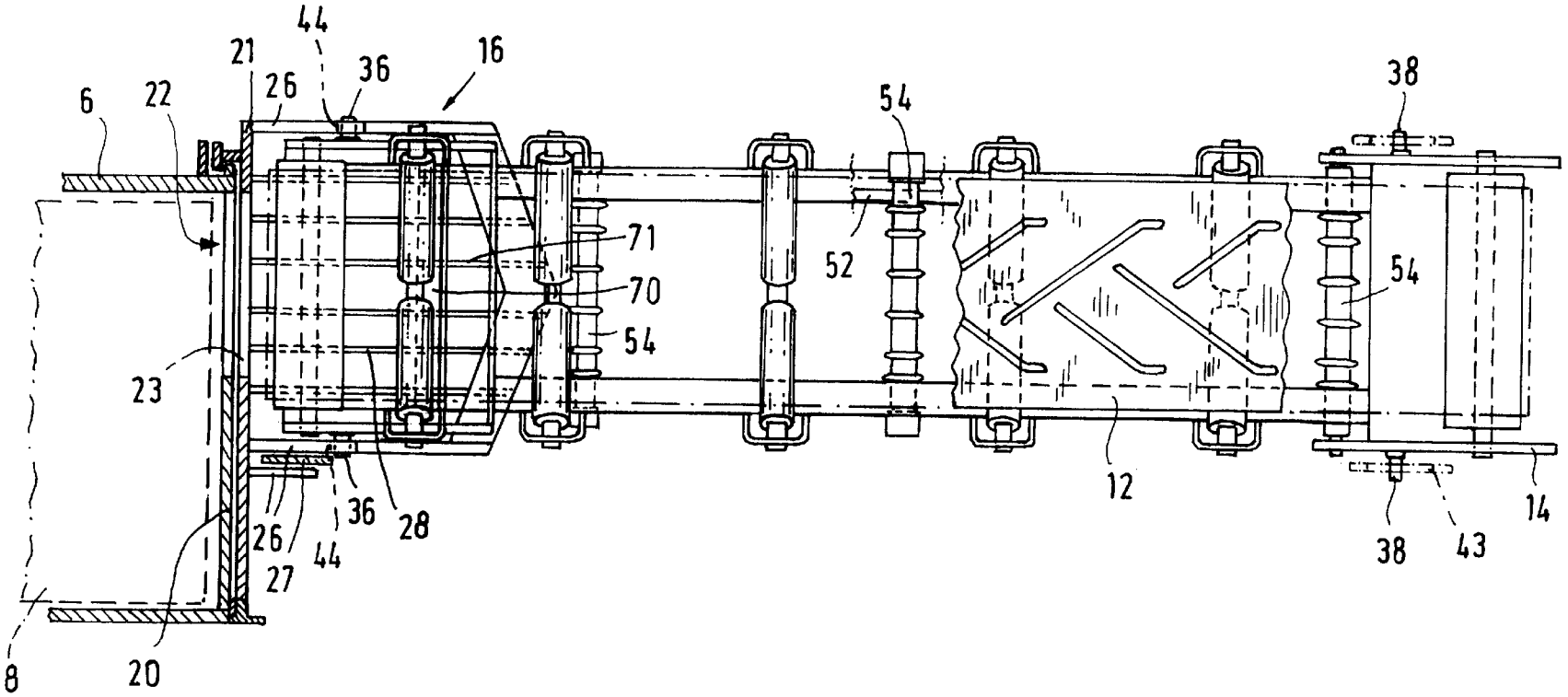
FIG. 5 is a top plan view along line V—V of FIG. 4.

As shown in FIGS. 3 and 5, to achieve as complete a removal of the milled material as possible, the milling roller 8 is usually surrounded by a housing in which the wall directed towards the direction of travel is formed as a cover plate 20 having a passage opening 22 for the milled material. The passage opening always has the same position relative to the milling roller 8, even if the settings of the depth of milling differ.

The milling roller 8 is provided with chipping tools arranged in the shape of a coil and being arranged such that the milled material is transported to the passage opening 22 in the cover plate 20.

Figures 2A, 2B:
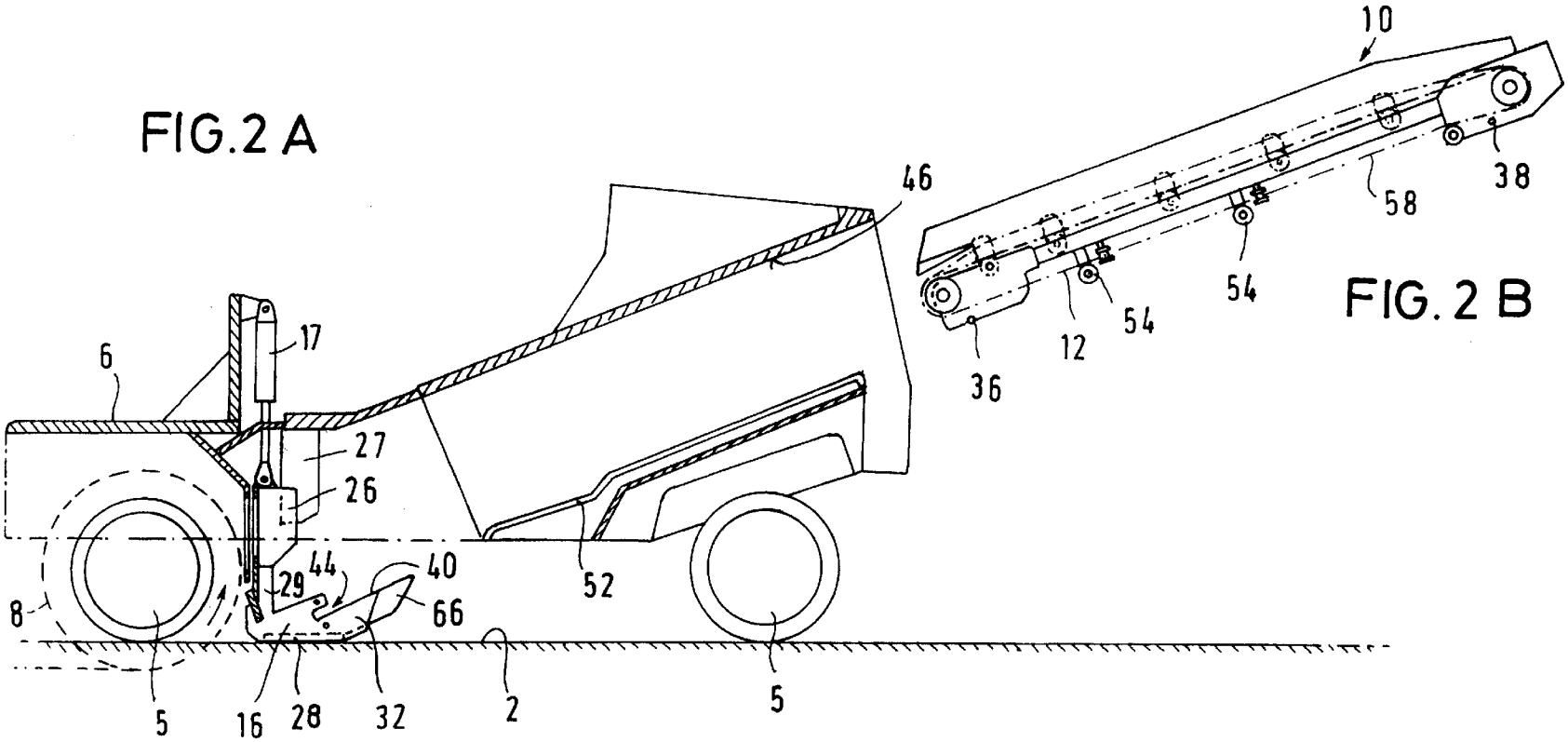
FIG. 2*a* is a schematic representation of the position of the belt shoe within the machine frame relative to the milling roller.
FIG. 2*b* shows a conveyor means having a transport belt and being insertable into the belt shoe.

A belt shoe 16 is fixed on the machine frame 6 in a vertical guide 26, 27 in a guided and height-adjustable manner as can be seen in FIGS. 2A and 3. The vertical guide 26, 27 comprises a plate 27 extending vertically downwards from the machine frame 6 and engaging between a lateral wall element 29 of the belt shoe 16 and a vertical guiding element 26 fixed to the wall element 21. A piston cylinder unit 17 fixed to the machine frame 6 is provided for height-adjusting the belt shoe 16. By means of this piston cylinder unit, the belt shoe can be raised in a vertical direction to overcome obstacles, for example. In this process, the belt shoe 16 cannot be pressed downwards, but can only be raised when required. When the depth of milling is raised, the position of the belt shoe 16 adjusts automatically by contacting the ground.

The belt shoe 16 receives the end, on the side of the milling roller, of the conveyor means 10 up to the limit stopper position in the belt shoe, where the lower end of the conveyor means is supported pivotably. See FIGS. 1 and 4. In this process, the conveyor means 10 remains movable longitudinally to conveyor means 10, in the longitudinal direction of the conveyor means 10. The conveyor means 10 remains in the end position in the belt shoe 16 due to its own weight; it can, however, additionally be fixed or supported in a biased manner against the stopper by means of a tension spring 62, as shown in FIG. 1.

With reference to FIGS. 3 and 5, the belt shoe 16 comprises a vertical wall element 21 abutting on the cover plate 20 and having a passage opening 23, a grate 28 projecting horizontally in the direction of travel on the lower end of the wall element 21 as well as lateral walls 32 extending parallel to the conveyor means 10 and projecting upwards, the end, on the side of the milling roller, of the conveyor means 10 being pivotable therebetween.

The passage opening 23 of the wall element 21 co-operates with the passage opening 22 of the cover plate 20 such that the height of the passage openings for the milled material remains constant and independent of the depth of milling, the passage opening 23 of the wall element 21 ensuring the height of the passage being constant relative to the conveyor means according to the depth of milling.

Figure 4:
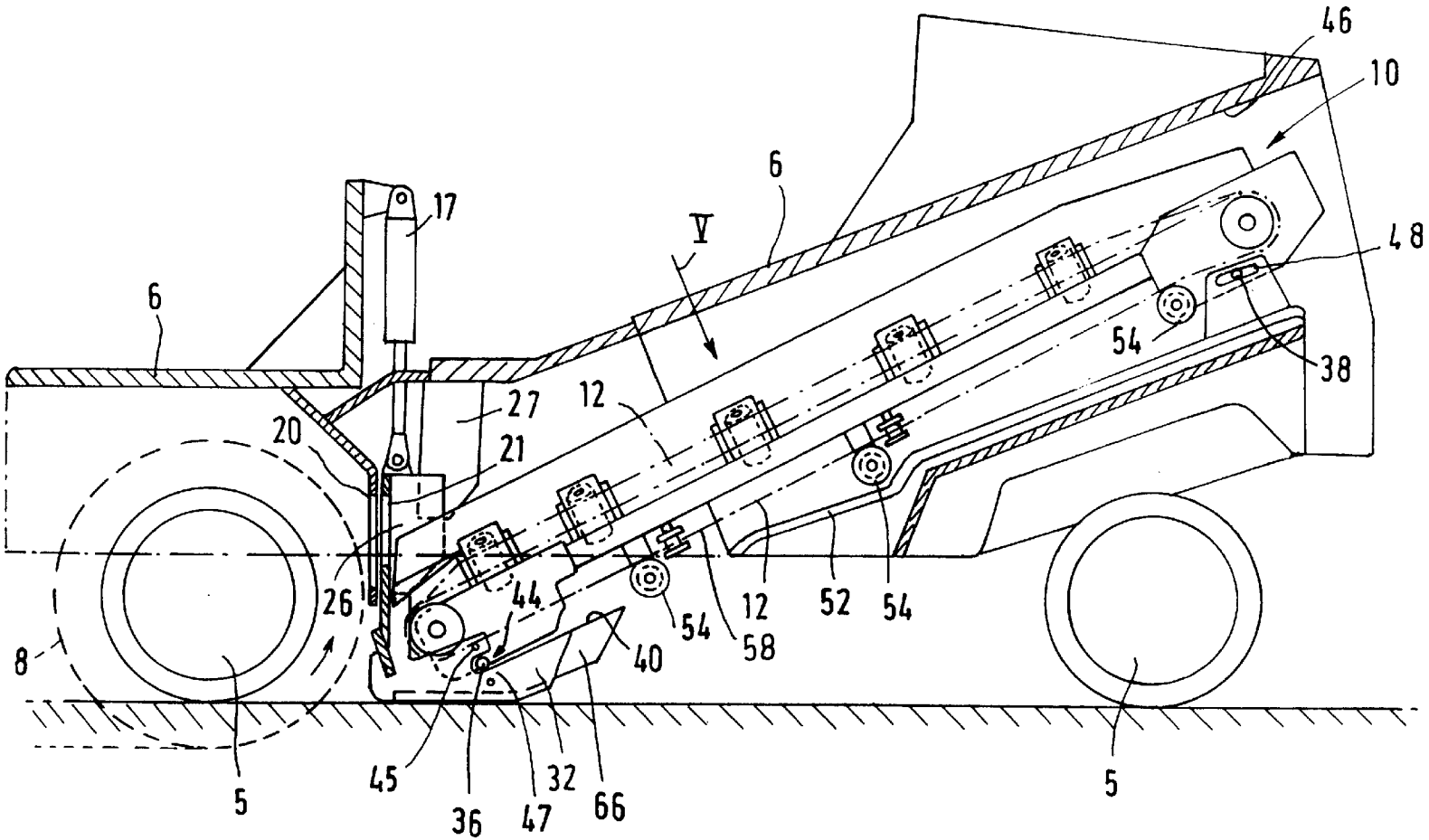
FIG. 4 shows the conveyor means in an end position in the belt shoe.

The guiding and coupling means of the conveyor means 10 preferably consists of guide bolts 36 projecting laterally and transversely to the direction of travel and being adapted to the guiding means 40, 44 of the belt shoe 16, as shown in FIG. 4.

Continuing to refer to FIG. 4, the belt shoe 16 comprises a guide surface 40 as a guiding means extending at the angle of inclination of the conveyor means 10, the length thereof being dimensioned such that, for example while dismantling the conveyor means, it is supported at the rear end thereof, at least until other supporting elements are engaged in a shaft 46 of the machine frame 6.

On the end of the guide surface 40 directed towards the milling roller 8, a bolt receiver 44 of an approximately semicircular recess is arranged serving as a limit stopper for the conveyor means 10.

Deviating from the representation in FIGS. 2*a* and 3, the bolt receiver 44 can consist of a longer groove extending parallel to the guide surface 40 and being open on one side thereof, so that it is possible to longitudinally guide the guide bolts 36 without the conveyor means being able to lift off in the horizontal direction. As the guide bolts 36 have a round cross sectional shape, the conveyor means 10 can be pivoted relative to the belt shoe 16, for example when the depth of milling is changed.

The guide bolts 36 can be secured on the bolt receiver 44 by plates 47 being slid onto the guide bolts 36 and being screwed to the belt shoe 16 above or below the bolt receiver 44 by means of screws 45.

As an alternative to the guide surfaces 40, rails or grooves for receiving the guide bolts 36 can be provided on the lateral walls 32 of the belt shoe 16.

The lower end of the conveyor means 10 can be held in the end position of the bolt receiver 44 by means of a tension spring 62, the conveyor means 10 abutting on the guide surfaces 40 in a longitudinally slidable way.

According to the respective embodiment and as shown in FIG. 5, the grate 28 of the belt shoe 16 can serve as a holding-down device or as a guide shoe. In the interior of the belt shoe, stiffening ribs 70 can be provided transversely to the lateral walls 32 to increase the load capacity of the belt shoe 16 and to support the grate bars 71 of the grate.

With reference to FIGS. 3, 4 and 5, in the shaft 46 of the machine frame 6, rails 52 are arranged to guide the conveyor means 10 during assembly and disassembly, which cooperate with guiding rolls 54 of the conveyor means 10. The guiding rolls 54 extending transversely to the conveyor means 10 further serve as support rollers for the lower run 58 of the transport belt 12 of the conveyor means 10. In all, three support rollers 54 are arranged on the bottom side of the conveyor means 10, the distances thereof being selected such that the conveyor means 10 is guided when being inserted into the shaft 46 of the machine frame, at least until the rear guide bolts 36 abut on the guide surfaces 40 on the upper edges of the lateral walls 32. Further laterally projecting guide bolts 38 are provided on the frontal end of the conveyor means 10, which are insertable into the shaft 46 in longitudinal supports 48 being arranged on both sides of the conveyor means 10 when the conveyor means 10 is introduced in the belt shoe 16. The longitudinal supports 48 allow for pivoting the conveyor means within the framework of the height adjustment of the belt shoe and enable the adjustment of the length in this process. Simultaneously, they raise the conveyor means 10 such that the support rollers 54 are lifted off the rails 52 so as to be able to rotate freely to support the lower run 58 of the transport belt 12.

Due to the readily dismountable support on the belt shoe 16 and the guides provided in the shaft 46, the conveyor means 10 can be assembled and dismantled by a single person by means of a crane. As the guiding and coupling means on the belt shoe 16 allows for readily assembling and dismantling the rear end of the guiding means, repair and maintenance work can be performed by just a single person in a very short time.

What is claimed is:

1. A device for milling off ground surfaces, especially roadways, comprising:

a wheel frame:

a machine frame supported by said wheel frame;

a milling roller, supported by said machine frame and extending transversely to the direction of travel;

at least one conveyor means arranged in front of said milling roller in the direction of travel for removing the milled material;

a shield arrangement extending transversely to the direction of travel between said milling roller and said conveyor means, said shield arrangement including a vertical cover Plate with a passage opening defined therein for the milled material;

a belt shoe, fixed to said machine frame in a height adjustable manner, said belt shoe dismountably supporting the end of said conveyor means on the side of said milling roller;

guiding means formed by adapting said belt shoe and said conveyor means to one another; and coupling means formed by adapting said belt shoe and said conveyor means to one another; a vertical wall element with a second passage opening defined therein, wherein;

a grate extending from the lower end of said vertical wall element in the direction of travel; and lateral walls extending upwards and parallel to said conveyor means and enclosing said grate, said lateral walls pivotably supporting the end of said conveyor means on the side of said milling roller; wherein said belt shoe further comprises stiffening ribs extending transversely to said lateral walls to support said grate.

2. The device of claim 1 wherein said belt shoe is approximately L-shaped in its longitudinal section.

3. The device of claim 2 wherein said belt shoe further comprises lateral walls extending upwards and parallel to said conveyor means and enclosing said grate, said lateral walls pivotably supporting the end of said conveyor means on the side of the feed end of the conveyor.

4. A device for milling off ground surfaces, especially roadways, comprising:

a wheel frame;

a machine frame supported by said wheel frame;

a milling roller, supported by said machine frame and extending transversely to the direction of travel;

at least one conveyor means arranged in front of said milling roller in the direction of travel for removing the milled material;

a shield arrangement extending transversely to the direction of travel between said milling roller and said conveyor means, said shield arrangement including a vertical cover plate with a passage opening defined therein for the milled material;

a belt shoe, fixed to said machine frame in a height adjustable manner, said belt shoe dismountably supporting the rear end of said conveyor means and comprising:

a vertical wall element with a second passage opening defined therein;

a grate extending from the lower end of said vertical wall element in the direction of travel; and lateral walls extending upwards and parallel to said conveyor means and enclosing said grate, said lateral walls Divotably supporting the rear end of said conveyor means;

guiding means formed by adapting said belt shoe and said conveyor means to one another; and coupling means formed by adapting said belt shoe and said conveyor means to one another;

wherein said conveyor means extends upwards at an angle of inclination to the horizontal line and said guiding means includes guiding elements on said lateral walls of said belt shoe extending at the angle of inclination on said conveyor means.

5. The device of claim 4 wherein said guiding means further comprises guide bolts on said conveyor means.

6. The device of claim 5 wherein said guiding means further includes reception means for said guide bolts and in which said guide bolts are lockable, said reception means configured to serve as a limit stopper for said conveyor means.

7. The device of claim 4 wherein said guiding elements further include guide surfaces on the upper edges of said lateral walls which extend at the angle of inclination of said conveyor means.

8. The device of claim 4 wherein said guiding elements include rails and grooves extending at the angle of inclination of said conveyor means and adapted to sidably receive said guide bolts.

9. The device of claim 8 wherein said machine frame further includes a shaft extending at the angle of inclination of said conveyor means and said conveyor means is insertable into said belt shoe.

10. The device of claim 9 wherein said rails are located on said shaft and said conveyor means further includes guiding rolls.

11. The device of claim 10 wherein said conveyor means is insertable into said belt shoe through a pairing of said rails and said guiding rolls.

12. The device of claim 10 wherein said conveyor means further comprises a transport belt.

13. The device of claim 12 wherein the lower run of said transport belt is supported by said guiding rolls.

14. The device according to claim 4 wherein said conveyor means is guided and movably supported by and in said belt shoe and further including a tension spring which biases said conveyor means towards said milling roller.

15. The device of claim 4 wherein said belt shoe further comprises a shield on the side of said belt shoe facing the direction of travel.

16. The device of claim 15 wherein said guiding means and said coupling means include laterally projecting guide bolts; and said conveyor means further comprises two additional guide bolts on the end of said conveyor means in the direction of travel, said additional guide bolts being insertable into longitudinal supports located on each side of said conveyor means, when said conveyor means is inserted in said belt shoe.

17. The device of claim 4 wherein said guiding means and said coupling means include laterally projecting guide bolts.

18. A front-loading milling cutter, comprising:

a frame;

a pair of front wheels;

a pair of rear wheels;

a milling roller carried by said frame transverse to the direction of travel;

a housing for said milling roller wherein the wall of said housing directed toward the direction of travel is formed as a cover plate having a passage opening for the milled material to pass through;

a first transport belt for transferring the milled material toward the front end of the milling cutter to a discharge belt, said discharge belt being pivotable in inclination and laterally; and a belt shoe dismountably supporting said first transport belt; wherein said frame includes an inclined shaft for removably receiving said first transport belt.

19. The device of claim 18 wherein said shaft includes rails to guide said first transport belt during assembly and disassembly.

20. The device of claim 19 wherein said first transport belt include rollers to cooperate with said rails.

21. The device of claim 18 wherein said shaft includes rollers to guide said first transport belt.

22. The device of claim 21 wherein said first transport belt includes rails to cooperate with said rollers.

23. The device of claim 18 wherein said first transport belt includes at least one orienting pin.

24. The device of claim 23 wherein said shaft includes at least one receiving opening configured to cooperate with said orienting pin.

25. The device of claim 21 wherein said receiving opening is located on said belt shoe to act as a pivot point for said first transport belt.

26. The device of claim 25 wherein said orienting pin is a bolt.

27. The device of claim 24 wherein said receiving opening is located on said belt shoe to act as a stop to maintain said first transport belt in said shaft.

28. The device of claim 24 wherein said receiving opening is a slot.

29. A milling cutter device, comprising:

a wheel frame;

a machine frame supported by said wheel frame;

a milling roller supported by said wheel frame;

a conveyor means for moving the milled material away from said milling roller for removal; and a belt shoe dismountably supporting said conveyor means;

a wall directed toward the direction of travel and located between said milling roller and said conveyor means wherein said wall includes a passage opening for the milled material to pass through; and said machine frame includes an inclined shaft to removably receive said conveyor means.

30. The device of claim 29 wherein said shaft includes rails to guide said conveyor means.

31. The device of claim 30 wherein said conveyor means includes rollers to cooperate with said rails.

32. The device of claim 29 wherein said shaft includes rollers to guide said conveyor means.

33. The device of claim 32 wherein said conveyor means includes rails to cooperate with said rollers.

34. The device of claim 29 wherein said conveyor means includes at least one orienting pin.

35. The device of claim 34 wherein said shaft includes at least one receiving opening configured to cooperate with said orienting pin.

36. The device of claim 35 wherein said receiving opening is located on said belt shoe to act as a pivot point for said conveyor means.

37. The device of claim 35 wherein said receiving opening is located on said belt shoe to act as a stop to maintain said conveyor means in said shaft.

38. The device of claim 35 wherein said receiving opening is a slot.

39. The device of claim 34 wherein said orienting pin is a bolt.

* * * * *

UNITED STATES PATENT AND TRADEMARK OFFICE

CERTIFICATE OF CORRECTION

PATENT NO. : 6,296,318 B1
DATED : October 2, 2001
INVENTOR(S) : Simons et al.

It is certified that error appears in the above-identified patent and that said Letters Patent is hereby corrected as shown below:

Column 1,
Lines 8-10, delete "This applications claims benefit of PCT/EP98/02755, filed May 12, 1998, and German application no. 197 26 122.1, filed Jun. 20, 1997."
Line 60, delete "veyor".

Column 6,
Line 7, delete "Plate" and insert -- plate --.
Line 60, delete "Divotably" and insert -- pivotably --.

Column 7,
Line 16, delete "sidably" and insert -- slidably --.

Column 8,
Line 16, replace "21" with -- 24 --.

Signed and Sealed this

Twenty-fifth Day of June, 2002

*Attest:*

*Attesting Officer*

JAMES E. ROGAN
*Director of the United States Patent and Trademark Office*